US008099983B2

(12) United States Patent
Ballheimer et al.

(10) Patent No.: US 8,099,983 B2
(45) Date of Patent: Jan. 24, 2012

(54) FRONT-LOADING LAUNDRY TREATMENT MACHINE

(75) Inventors: Galina Ballheimer, Berlin (DE); Bernhard Heym, Berlin (DE); Rainer Jurmann, Falkensee (DE); Mark Sauer, Bergfelde (DE); Wilfried Wildung, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 498 days.

(21) Appl. No.: 12/308,734

(22) PCT Filed: Jun. 6, 2007

(86) PCT No.: PCT/EP2007/055546

§ 371 (c)(1),
(2), (4) Date: Dec. 19, 2008

(87) PCT Pub. No.: WO2008/000592

PCT Pub. Date: Jan. 3, 2008

(65) Prior Publication Data

US 2009/0301143 A1 Dec. 10, 2009

(30) Foreign Application Priority Data

Jun. 27, 2006 (DE) ..... 10 2006 029 480

(51) Int. Cl.
*D06F 39/14* (2006.01)

(52) U.S. Cl. ..... 68/196; 68/23 R; 68/24

(58) Field of Classification Search ..... None
See application file for complete search history.

(56) References Cited

U.S. PATENT DOCUMENTS

| | | | | |
|---|---|---|---|---|
| 6,422,047 | B1 * | 7/2002 | Magilton | 68/12.06 |
| 2004/0244438 | A1 * | 12/2004 | North | 68/23.2 |
| 2005/0126231 | A1 | 6/2005 | Brinkmann et al. | |

FOREIGN PATENT DOCUMENTS

| | | |
|---|---|---|
| DE | 102 28 602 | 2/2003 |
| DE | 20 2004 012 221 U1 | 11/2004 |
| DE | 20 2006 012 320 U1 | 11/2006 |
| EP | 1 529 869 | 5/2005 |
| WO | WO 03/004754 | 1/2003 |

OTHER PUBLICATIONS

International Search Report PCT/EP2007/055546.

* cited by examiner

*Primary Examiner* — Michael Kornakov
*Assistant Examiner* — Ryan Coleman
(74) *Attorney, Agent, or Firm* — James E. Howard; Andre Pallapies

(57) ABSTRACT

A washing machine includes a liquor container suspended for oscillating in a housing. A washing drum is rotatable within the liquor container. A material-elastic collar is connected for establishing a liquid tight seal on the edge of a front-side loading opening of the liquor container, connecting with a housing-side loading opening, and with a door mounted for sealing the housing-side loading opening. A filling element is located on the door and has a curved outward portion in the shape of a truncated cone. The filling element has a surface area with at least one recess commencing close to a largest diameter of the cone portion, and forms a rising surface of sickle shape in the direction of the interior of the drum and toward a smallest diameter of the cone on the surface area thereof.

33 Claims, 6 Drawing Sheets

FRONT-LOADING LAUNDRY TREATMENT MACHINE

BACKGROUND OF THE INVENTION

The invention relates to a front loading laundry processing machine, preferably a washing machine, with a liquor container suspended in the appliance housing in an oscillating manner, and with a washing drum rotatable in the liquor container, with a material-elastic collar by means of which the liquor container is connected on the edge of its front-side loading opening to the housing-side loading opening in a liquid tight manner, as well as with a door sealing the housing-side loading opening with a filling element curved outwards towards the interior of the drum in the manner of a truncated cone.

The term "truncated cone" will in the following be understood to refer to a conical body with any base area with content arcs having any radii, e.g. in addition to circular base areas, also with oval, elliptical or oval base areas. The invention is described in the following with reference to a washing machine, but it may also be applied to a tumble dryer.

In order to prevent items to be washed, conveyed upwards during the washing process, from remaining on the pot-shaped filling body element in washing machines of prior art of the type already mentioned, an inwardly directed bevel is formed in the upper region of the filling element. The washing is able to slide down this obliquity and drop back into the interior of the drum by the force of gravity. This simple form of a washing deflector is used in many washing machines.

In a particular design of a bevelled filling element disclosed in DE 102 28 602 A1 the inwardly directed region of the filling element has a structure in the form of planar elevations and recesses arranged adjacent to each other. This shaped corrugated or fluted structure of the filling element projecting into the laundry processing space is intended to reinforce the introduction of mechanics into the items to be washed. The proposed shaping does positively influence the function as a washing deflector because no deflecting force component, but instead a rocking motion acting in small regions of the fabric components of the washing is generated.

When the washing machine is running, and particularly during the spinning acceleration, vibrations of the elastically suspended system consisting of the liquor container and washing drum are generally generated due to imbalance. Moreover, the overhung-mounted washing drum also vibrates to a lesser extent than the liquor container. To prevent the drum and the fixed collar from rubbing against each other, an adequate distance must be maintained between them. The same applies to the distance from the edge of the drum opening to the filling element projecting into the drum interior. These general conditions give rise structurally, between the drum edge, collar and filling element, to an annular gap which presents the risk that items of washing may be caught in it during the operation of the washing machine and items of washing moved with the rotating drum may rub against the fixed collar. As a result of this friction both the washing and the collar may also be damaged.

The tendency for washing to be conveyed from the rear region of the washing drum to the front region is reinforced by the size of the drum and the width of its filling opening. Besides the risk of damage to the washing and the collar due to mutual abrasion, the frictional forces impose a higher load on the drum drive motor. At a predetermined motor speed the drive moment that must necessarily be applied increases.

The washing moved with the rotating drum could also become trapped in the gap between the edge of the washing drum and the collar, which considerably increases the risk of damage to the washing and may prevent the drum from starting during washing and spinning. This will also overload the drive motor. Such risks are presented particularly when the drum is filled with washing to its maximum capacity.

To be able to eliminate the risks previously described washing deflectors have been developed as additional components besides the filling element. DE 103 59 011 B3 proposes fitting an annular elastic washing deflector to the liquor container so that the space between the filling element and the collar is at least partially filed. The constriction of the annular gap thus obtained reduces the risk of washing penetrating this space.

DE 20 2004 012 221 U1 describes a washing deflector which is secured in the upper region of the loading opening on the liquor container and extends into the region covered by the collar. The washing deflector has a triangular cross-section with symmetrical or asymmetrical edges. The apex of the triangle points upwards towards the centre of the filling opening. The triangular shape causes the washing to be detached in both directions of rotation with the same intensity, and in the case of asymmetrical triangles with an intensity that is dependent on the direction of rotation. To reduce the friction on the washing deflector is provided with a coating having very high lubricity.

In practice, however, that washing is still damaged by the use of the washing deflectors described, and undesirable friction on the collar still cannot be prevented.

Brief Summary of the Invention

The object of the invention is to design a washing machine already described without the use of additional components so that the function of the washing deflection is maintained, even reinforced, without risking damage to the collar due to friction during the operation of the washing machine, and so that the operation of the washing machine is rendered more reliable in respect of the washing drum drive. It will be possible to implement the invention and achieve the advantages that can be gained with its application at the lowest possible cost.

According to the invention the object is achieved by the features listed in claim 1. Advantageous designs of the invention are described in the dependent claims, the features of which can be applied individually or in any combination with each other and with the features of claim 1.

The washing machine designed according to this invention is characterised in that the surface area of the filling element has at least one recess which commences close to the largest diameter of the truncated cone and forms a rising surface similar to a sickle shape in the direction of the drum interior and towards the smallest diameter of the truncated cone along the surface area. The sickle-shaped surface forms a sliding surface with a pitch directed into the drum interior, which in practice repels the items to be washed bearing against this surface, in the direction of rotation, back into the drum interior without friction on the surface of the filling element, consisting in most cases of glass.

A force which, as in the case of a conveyor screw, has a component that is tangential to the surface area of the filling element and an additional force component that is directed axially into the drum interior, acts on the washing due to the filling element according to the invention, particularly during the operation of the drum. This axial force component in particular conveys the washing displaced to the front drum region back into the central region of the drum, and prevents washing from reaching the critical region of the gap between the collar and the filling element without any contact being first established with the collar.

The dynamics of the force generated is mainly dependent on the speed of the drum, and the action of the force on the washing is reinforced during the drum acceleration. The action of the filling element designed according to the invention differs from the mode of operation of washing deflectors of prior art because of this and, in particular, due to the axially acting force component, apart from the much lower friction between the surfaces of the washing deflector according to the invention and the washing.

As described above, the tendency for the washing or items thereof to be pushed out of the drum opening increases with the increasing speed of the drum. The design of the filling element according to the invention provides the advantage that the tendency for the force acting inwards towards the drum to convey the washing back into the drum increases to the same degree, i.e. also as the speed increases.

The surface similar to a sickle shape can be irregularly dimensioned and shaped to produce different deflector actions designed to achieve the washing objective. Unlike the preferred shape with a constant pitch, the sickle-shaped surface may have a non-uniform pitch in certain regions along its extension. The deflector action of the filling element may also be influenced by the fact that the surface area has a varying conical angle in certain regions in the region of the recess.

In the design of the invention the filling element has two mutually aligned recesses producing a deflector action in both directions of rotation of the drum. Depending on whether the washing machine is operated mainly in a uniform reversing manner, or in a preferred direction of rotation, the recesses aligned in mutually opposite directions are designed symmetrically or asymmetrically. The symmetrical design means that the deflector forces, which are the same in both directions of rotation, are transmitted to the items to be washed. In the preferred asymmetrical design a stronger deflector effect is produced in the main direction of rotation than in the opposite direction of rotation.

The washing machine designed according to the invention reduces the friction of the washing in the region of the filling opening and the risk that washing may be conveyed out of the filling opening of the drum. The filling element according to the invention diverts the washing extremely gently from the region of the filling opening. Damage to the items to be washed by friction is significantly reduced and the life of the collar increased.

The load acting on the drum drive motor is also reduced with the reduction in friction, its energy consumption falls and prevention of drum starting due to items of washing caught in the drum is effectively eliminated. Compared to appliance configurations without the use of the invention it is possible to use motors of lower power, which may mean a reduction in costs. A further advantage is that a reduction in noise development that is clearly perceptible to the customer is associated with the use of the invention.

The additional expenditure associated with the invention is limited to the single production of a modified injection moulding for the specially designed filling element. The production process involved in the manufacture of the filling element and in its assembly in the frame of the loading door remains unchanged. Further adaptations or additional components are not required.

BRIEF DESCRIPTION OF THE DRAWINGS

The invention is explained in detail in the following by way of exemplary embodiments shown in the drawing, in which.

Detailed Description of the Present Invention

Figure 1:
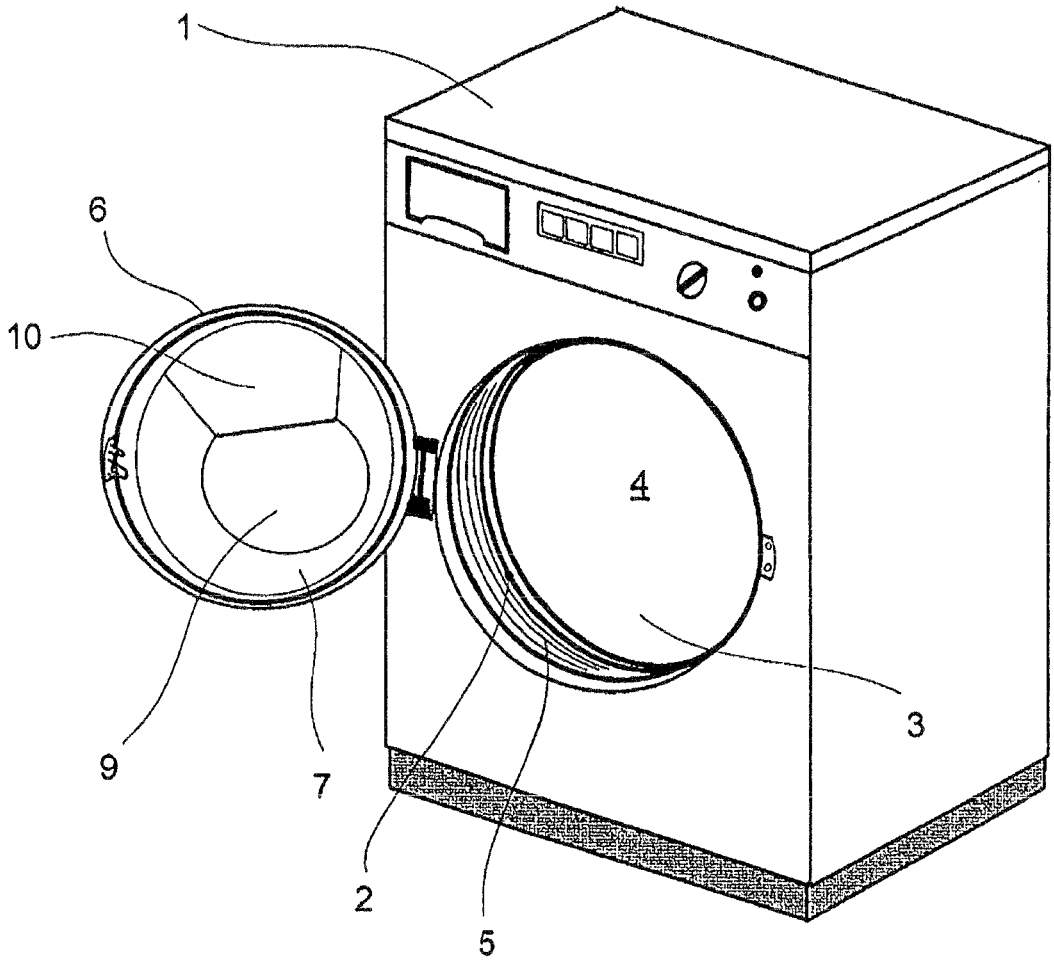
PRIOR ART Fig. 1
FIG. 1 shows a washing machine of prior art.
Figure 2:
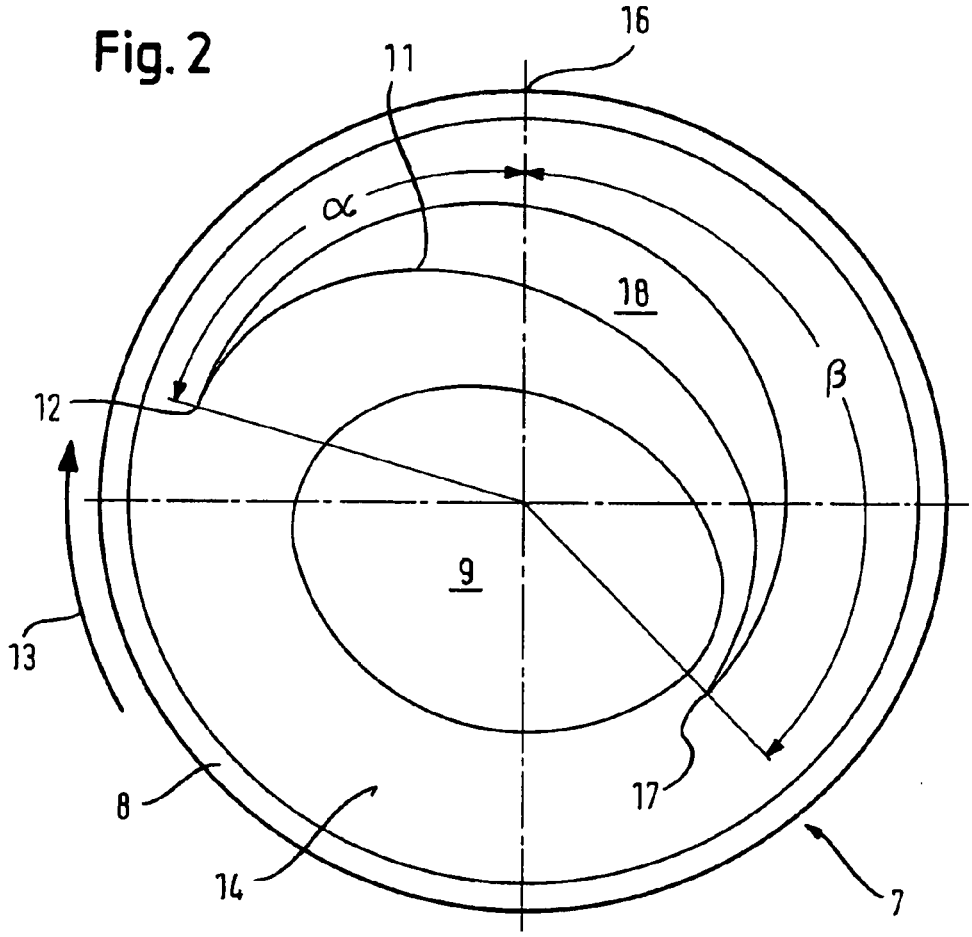
FIG. 2 shows a filling element according to the invention (1$^{st}$ embodiment) in a view of the smaller cone diameter.
Figure 4:
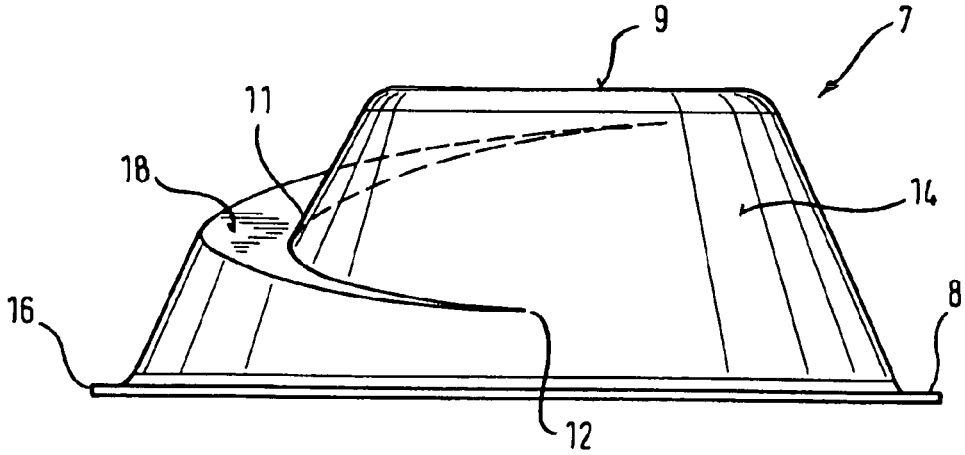
FIG. 4 shows the filling element according to FIG. 2 in a view from the side (orated from the installation position by 90°), FIG. 5 the filling element according to FIG. 2 in a view as in FIG. 4, but in the installation position and shaded three-dimensionally.
Figure 3:
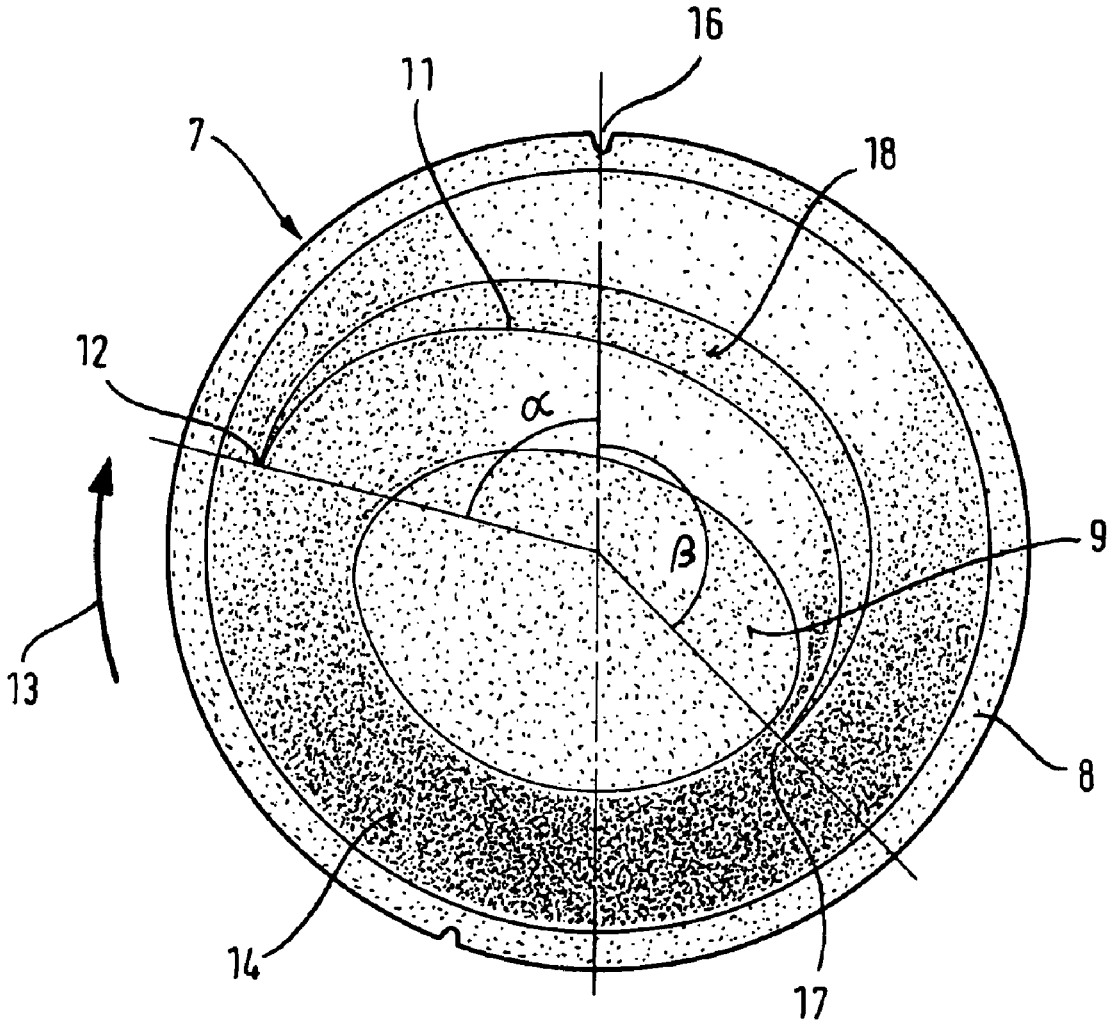
FIG. 3 shows the filling element according to FIG. 2 in the same view as the three-dimensional representation, with shading.
Figure 5:
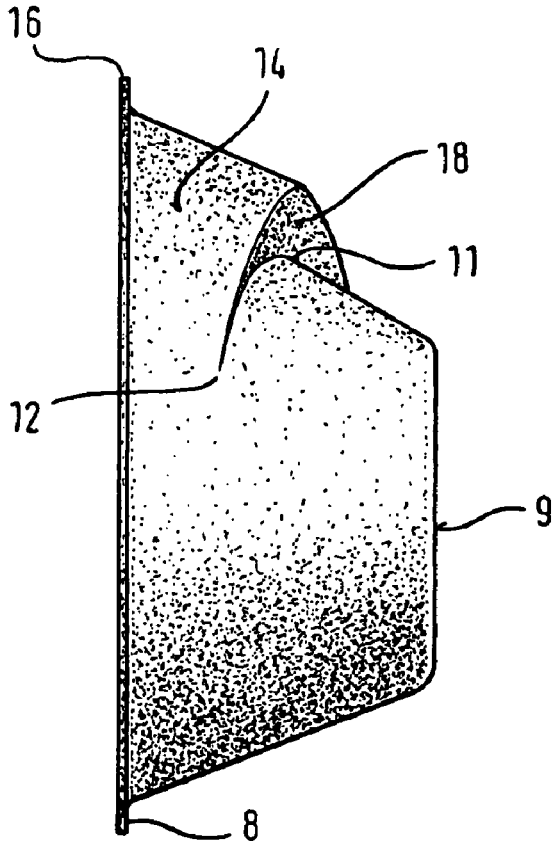
Figure 6:
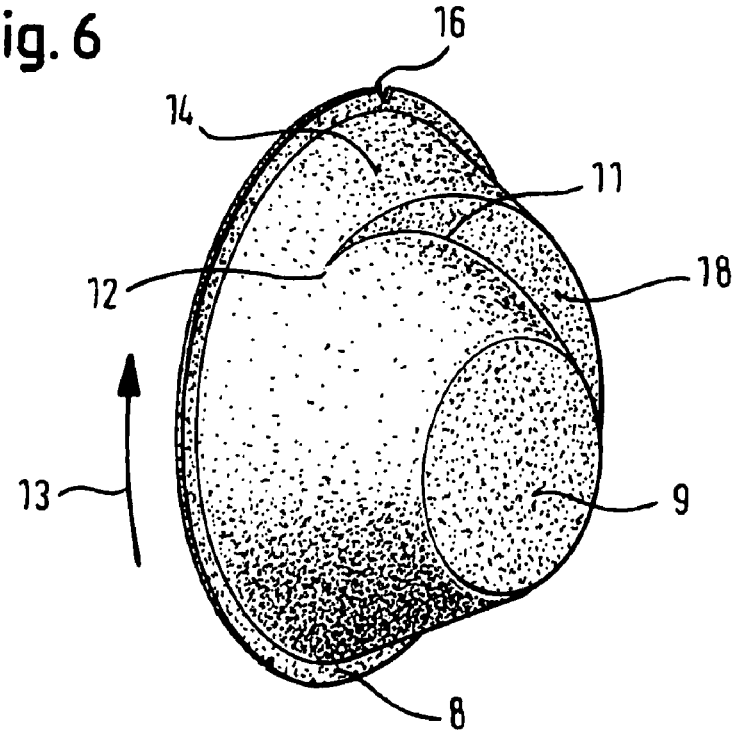
FIG. 6 shows the filling element according to FIG. 2 in a shaded perspective view.
Figure 7:
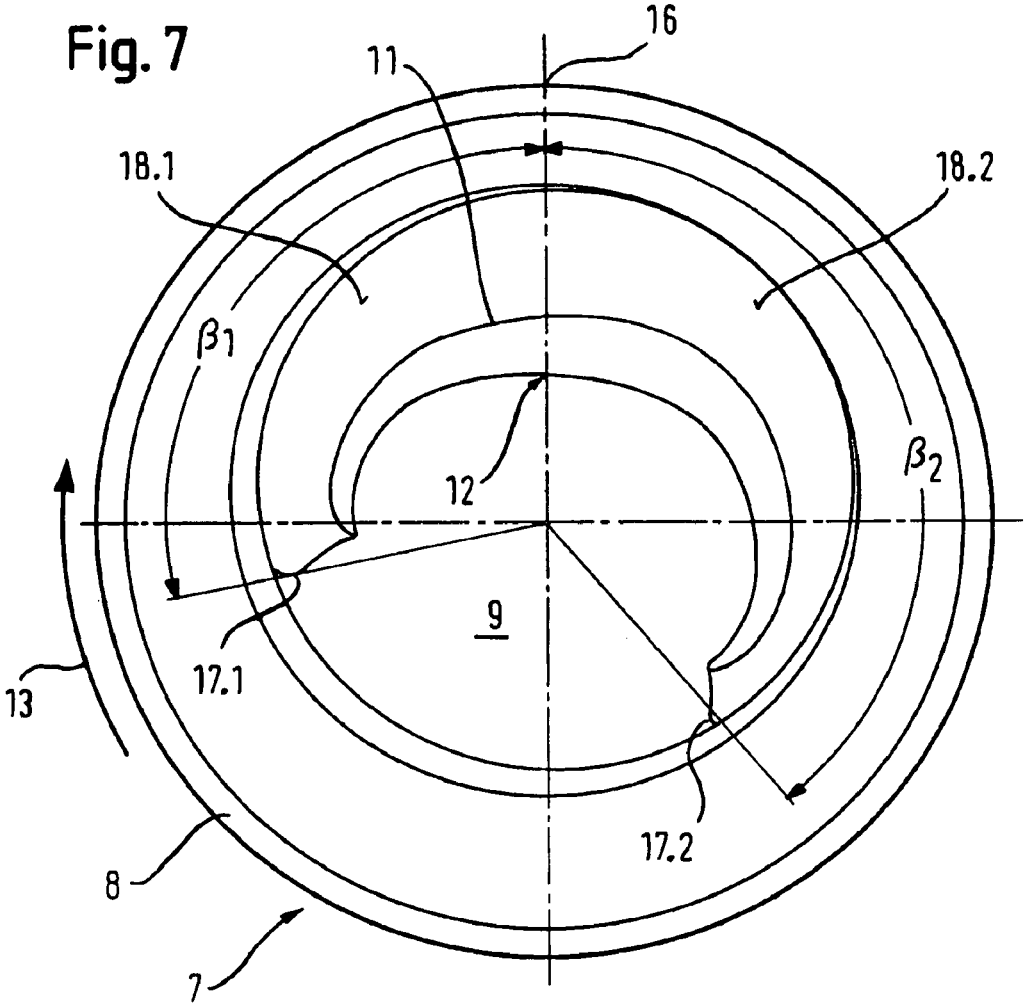
FIG. 7 shows another variant of the filling element according to the invention in a view as shown in FIG. 2.
Figure 9:
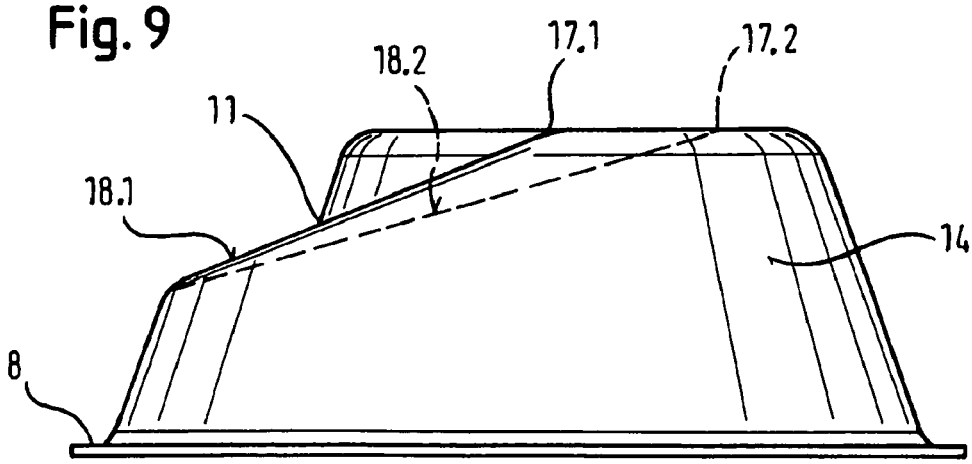
FIG. 9 shows the filling element according to FIG. 7 in a view as shown in FIG. 4.
Figure 8:
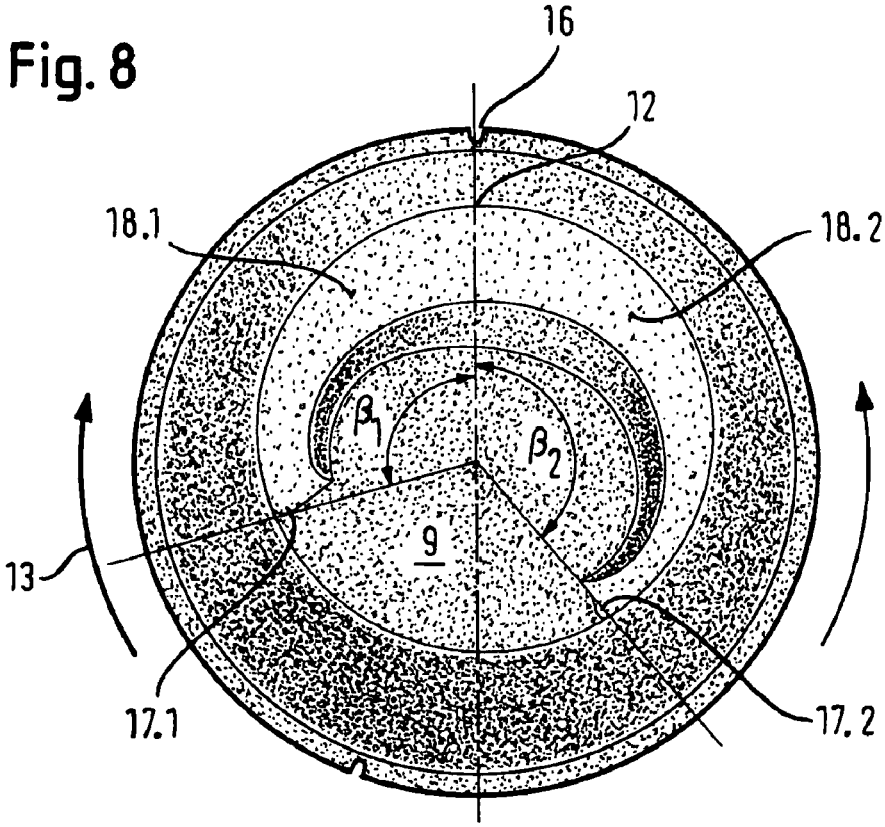
FIG. 8 shows the filling element according to FIG. 7 in a view as shown in FIG. 3.
Figure 10:
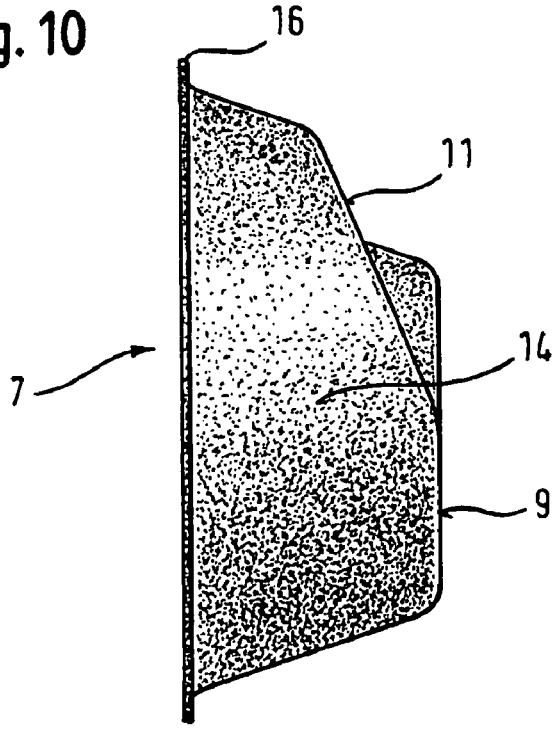
FIG. 10 shows the filling element according to FIG. 7 in a view as shown in FIG. 5.

FIG. 1 shows a front diagrammatic, perspective view of a washing machine 1 of prior art. Liquor container 2 is suspended spring elastically in the housing of the machine, and in it is arranged drum 4, designed for accommodating the washing, so that is able to rotate about a horizontal axis. Liquor container 2 and drum 4 each have at the front an opening 3, which openings are concentric relative to each other and lie almost in the same plane—they are therefore given the same reference number—through which drum 4 can be loaded and unloaded with the items to be washed.

The opening provided in the appliance housing and corresponding to loading opening 3 of liquor container 2/drum 4 is connected in a sealing manner by means of a material-elastic rubber collar 5 to opening 3 of liquor container 2 and can be sealed with a pivotably hinged door 6. Door 6 has a transparent filling element 7 of prior art. When door 6 is closed, filling element 7 seals the working region of the washing machine in a liquid-tight manner on the outside by means of a sealing ring of collar 5 not shown. Filling element 6 is firmly clamped over the bevelled edge region 8 in the door frame. Filling element 7, which is designed as a truncated cone and tapers conically inwards, projects into opening 3 of washing drum 4 when door 6 is closed. This prevents items of washing from being able to penetrate the region between filling element 7 and collar 5 from the drum interior. However, because of the required oscillating space of the liquor container 2 the items of washing are at an appropriate distance from each other. A vertical flat region 9 over which the operation can be monitored or inspected in washing machine 1 seals filling element 7 on the inside. Filling element 7 is provided with a bevel 10 by a known method in the upper third of the surface area of the truncated cone. Bevel 10 functions as a sliding face; items of washing conveyed upwards due to the rotary movement of the drum slide of from bevel 10 of filling element 7 and drop back into drum 4 due to gravity.

The exemplary embodiments of filling elements 7 designed according to the invention are reproduced for better illustration both as a drawing and as an image with shaded areas. The filling elements designed according to the invention take the place of filling element 7 in FIG. 1. However, instead of bevel 10 known from the state of the art, filling elements 7 in the exemplary embodiments shown are provided with a sickle-shaped recess 11.

The first exemplary embodiment (FIGS. 2 to 6) have a steadily rising recess 11 which extends along surface area 14 of the filling element cone around the periphery, from the lowest end 12 close to the largest diameter of the truncated cone. Recess 11 commences with its one end 12 in front of the upper vertex 16 of filling element 7, offset with respect to the direction of rotation 13 of the drum by an angle $\alpha$, and extends further from apex 16 of filling element 7 in the direction of rotation 13 of the drum 13 over a range of angles $\beta$, which is significantly greater than 90°. Recess 11, tapering outwards at both ends 12 and 17, forms a surface, viewed from the drum interior, which resembles a sickle shape 18. Recessed sickle surface 18 has a constant pitch directed from end 12 into the drum interior.

Recess 11 is designed so that edges are avoided and all transitions are smooth. Depending on the washing objective, sickle surface 18 may be of variable width and peripheral length. The action as a washing deflector my therefore be varied and hence adapted to the washing objective.

An additional possibility of varying the deflection action, not shown in the exemplary embodiments, consists in designing sickle surface 18 not as a flat surface but bent in a concave or convex or cylinder jacket shape over its length and/or width. Thus shaped, sickle surface 18 has a pitch which is irregular at least in regions. A further design possibility consists in designing the truncated cone of filling element 7 in the region of recess 11 so that surface area 14 has, in the upper region, a different pitch to the drum interior than in the lateral region without recess 11. This may influence the sliding motion of the items to be washed and the force with which the items of washing are fed back into drum 4.

A second exemplary embodiment of a filling element 7, which has two recesses 11 aligned in opposite directions, is shown in FIGS. 7 to 10. Both recessed sickle surfaces 18.1 and 81.2 are of different dimensions and alignments. Commencing from apex 16, the extend up against direction of rotation 13 over an angle range $\beta_1$ or in direction of rotation 13 over an angle range $\beta_2$. Unlike in the first example, sickle surfaces 18.1 and 18.2 do not taper outwards. The deflection action of recesses 11 is dependent on the direction of rotation in this embodiment, and in main direction of rotation 13 of drum 4 it is greater than in the opposite direction of rotation. Such a filling element 7 is ideal for washing machines 1 with two directions of rotation during washing, one of which is conceived as being opposite the other with a different main objective, e.g. wetting the items to be washed.

The use of a filling element 7, where sickle surfaces 18.1 and 18.2 are equally dimensioned and lie symmetrically to the perpendicular central plane of the truncated cone or to each other, may be preferred in washing machines 1 which are operated essentially in a uniformly reversing manner. The action as a washing deflector is equally intense in both directions of rotation 13 of the drum in the case of such a filling element 7.

In the design variants last listed the function as a washing deflector is effective in both directions of rotation. By suitably designing the pitches and an asymmetry of recesses 11 with their sickle surfaces 18.1 and 18.2, the deflection action dependent on the direction of rotation can be varied within wide limits, and hence tailored specifically to the mode of operation of washing machine 1.

The invention claimed is:

1. A front loading washing machine comprising:

a liquid container suspended in a housing of the machine in a manner for oscillating within the housing;

a washing drum rotatable within the liquid container;

a material-elastic collar for connecting the liquid container in a liquid tight manner on the edge of a front-side loading opening which connects with a housing-side loading opening;

a door mounted for sealing the housing-side loading opening; and a filling element disposed on the door and curved outwardly in the shape of a truncated cone, the filling element having on a surface area thereof at least one recess commencing close to a largest diameter of the truncated cone and forming a rising surface of sickle shape in a direction of the interior of the drum and towards a smallest diameter of the truncated cone on the surface area thereof.

2. The washing machine according to claim 1, wherein the rising surface is a non-linear two-dimensional surface.

3. The washing machine according to claim 1, wherein the rising surface has a constant pitch along its extension.

4. The washing machine according to claim 1, wherein the rising surface has a variable pitch along its extension.

5. The washing machine according to claim 1, wherein the surface area has a variable conical angle in various regions in the region of the recess.

6. The washing machine according to claim 1, wherein two rising surfaces aligned in opposite directions and resembling a sickle shape are recessed in the filling element.

7. The washing machine according to claim 6, wherein the two rising surfaces are recessed symmetrically to a perpendicular central plane of the filling element.

8. The washing machine according to claim 6, wherein the two rising surfaces have different pitch angles.

9. The washing machine according to claim 2, wherein the non-linear two-dimensional surface is a concave surface or a convex surface.

10. The washing machine according to claim 1, wherein the at least one recess extends around a portion of a periphery of the filling element.

11. A front loading washing machine comprising:

a liquid container suspended in a housing of the washing machine and structured to oscillate during operation of the washing machine;

a washing drum that is structured to rotate within the liquid container;

an elastic collar for connecting the liquid container in a liquid tight manner on the edge of a front-side loading opening which connects with a housing-side loading opening;

a door mounted for closing the housing-side loading opening; and a filling element disposed on the door and extending inwards into an interior of the drum and substantially being a shape of a truncated cone that extends from a first portion located proximate the door with a first diameter to a second portion located opposite the first portion with a second diameter that is less than first diameter, the filling element including an outer surface that extends from the first portion to the second portion, wherein the outer surface includes a step portion that extends around at least a portion of a periphery of the outer surface, the step portion having a first end and a second end, the first end of the two ends being closer in distance to the first portion and the second end of the two ends being closer in distance to the second portion such that the step portion gradually increases in distance from the first portion.

12. The washing machine according to claim 11, wherein the step portion rises at a constant pitch between the first end and the second end.

13. The washing machine according to claim 11, wherein the step portion varies in pitch between the first end and the second end.

14. The washing machine according to claim 11, wherein the step portion is a first step portion, and the outer surface includes a second step portion that is similar in shape to the first step portion and is aligned in an opposite direction.

15. The washing machine according to claim 14, wherein the first and second step portions are pitched, for at least a portion thereof, at different pitch angles.

16. The washing machine according to claim 11, wherein the step portion varies in width between the first end and the second end.

17. The washing machine according to claim 16, wherein the step portion has a first width at a position substantially equidistant along the step portion between the first and second end that is greater than a second width at the first and/or second end.

18. The washing machine according to claim 11, wherein the step portion is included in the outer surface for more than 180 degrees, viewed in cross section.

19. The washing machine according to claim 11, wherein the step portion is structured as a helix.

20. The washing machine according to claim 11, wherein the step portion is formed by a removal of a section of the truncated cone.

21. A front loading laundry apparatus comprising:

a housing that includes an opening;

a drum that is structured to rotate in at least a first rotational direction within the housing;

a door mounted for closing at least the opening in the housing; and a deflector disposed on the door and extending towards an interior of the drum and substantially being a shape of a truncated cone, the deflector including a laundry directing surface that is substantially formed as a helix such that the laundry directing surface starts at a first position on the deflector and extends around at least a portion of the deflector to a second position that is greater distance away from the door, wherein the clothes directing surface is structured to engage a piece of rotating laundry at the first position and to subsequently disengage the piece of rotating laundry at the second position that is further away from the door and towards an inner portion of the drum.

22. The apparatus of claim 21, wherein the clothes directing surface extends only between 180 and 270 degrees of the circumference of the deflector.

23. The apparatus of claim 21, wherein the majority of the clothes directing surface is located in an upper part of the circumference of the deflector.

24. The apparatus of claim 21, wherein the clothes directing surface is crescent shaped.

25. A front loading laundry treatment machine comprising:

an appliance housing with an opening, the appliance housing including a door for closing the opening from an exterior area;

a laundry drum disposed in the appliance housing and configured to oscillate with respect to the appliance housing;

a solution container suspended in the appliance housing and configured to oscillate with the laundry drum;

an elastic material sleeve that liquid-tightly connects the solution container to the appliance housing such that the opening exposes the solution container to the exterior area when the door is opened;

a filler body that frustro-conically bulges toward an interior portion of the laundry drum, wherein the filler body has a circumferential surface which includes a shaped-in portion that begins in a first area that is substantially at the largest diameter of the conical frustum, the shaped-in portion being formed into the circumferential surface towards the interior portion at a second area on the conical frustum, the filler body having a rising surface that rise along the circumferential surface from the first area to the second area in a shape of a sickle.

26. The machine of claim 25, wherein the rising surface has non-constant shape and/or dimension between the first and second areas.

27. The machine of claim 25, wherein the rising surface has constant gradient between the first and second areas.

28. The machine of claim 25, wherein the rising surface changes gradient between the first and second areas.

29. The machine of claim 25, wherein the circumferential surface has, regionally, a changing cone angle in a region of the shaped-in portion.

30. The machine of claim 25, further comprising a second rising surface that is formed into the filler body and oriented opposite the rising surface, the second rising surface having a sickle shape formed into the filler body.

31. The machine of claim 30, wherein the rising surface and the second rising surface are formed symmetrically with respect to a perpendicular central plane of the filler body.

32. The machine of claim 30, wherein the rising surface and the second rising surface have gradient angles differing from one another.

33. The machine of claim 25, wherein the rising surface is formed on a non-parallel plane to the circumferential surface.

* * * * *